United States Patent [19]

Allen

[11] Patent Number: 4,792,050

[45] Date of Patent: Dec. 20, 1988

[54] GUN RACK

[76] Inventor: Glen D. Allen, 7709 Flintrock Rd., North Little Rock, Ark. 72116

[21] Appl. No.: 158,796

[22] Filed: Feb. 22, 1988

[51] Int. Cl.[4] ..... A47F 7/00

[52] U.S. Cl. ..... 211/64; 211/88

[58] Field of Search ..... 211/64, 66, 88, 70.5, 211/60.1; 248/110, 111

[56] References Cited

U.S. PATENT DOCUMENTS

| | | | |
|---|---|---|---|
| 344,869 | 7/1886 | Sanford | 248/111 |
| 1,318,539 | 10/1919 | Butcher | 248/111 |
| 3,995,743 | 12/1976 | Blackburne | 248/110 X |
| 4,108,313 | 8/1978 | Bogar, Jr. | 211/64 |
| 4,700,807 | 10/1987 | Kubiak | 182/92 |

*Primary Examiner*—Reinaldo P. Machado
*Assistant Examiner*—Sarah A. Lechok Eley

[57] ABSTRACT

A gun rack for storing rifles, shotguns, and carbines, vertically, barrel down position, consisting of a base plate, mounted to wall or in cabinet, having support bolts projecting outward on which are mounted wedge shaped pieces which grip the gun stock by conforming to the shape of the stock as they rotate or pivot about the support bolt. The wedge shaped pieces having an angled surface which, when two pieces are joined together face to face, form a dovetail wedge. Spacing of the wedge pieces are adjustable to accomodate different gun stock widths.

1 Claim, 4 Drawing Sheets

GUN RACK

SUMMARY

The invention herein disclosed provides a gun rack, wall mounted or cabinet mounted, for storing shotguns, rifles and carbines, in the barrel down position, with sufficient clearance to accomodate scopes and slings. It is comprised of a base plate on which is mounted sets of conforming dovetail wedges by means of support bolts which act as pivot points around which each wedge half rotates to the extent required for conformance to the shape of the gun stock, butt end. By varying the length of the base plate and adding or subtracting sets of dovetail wedges, any number of guns can be supported. A gun is removed from the rack by lifting it upward until the narrower portion of the stock clears the wedge, then by moving it outward.

DESCRIPTION OF VIEWS OF DRAWINGS

DETAILED DESCRIPTION

Figure 1:
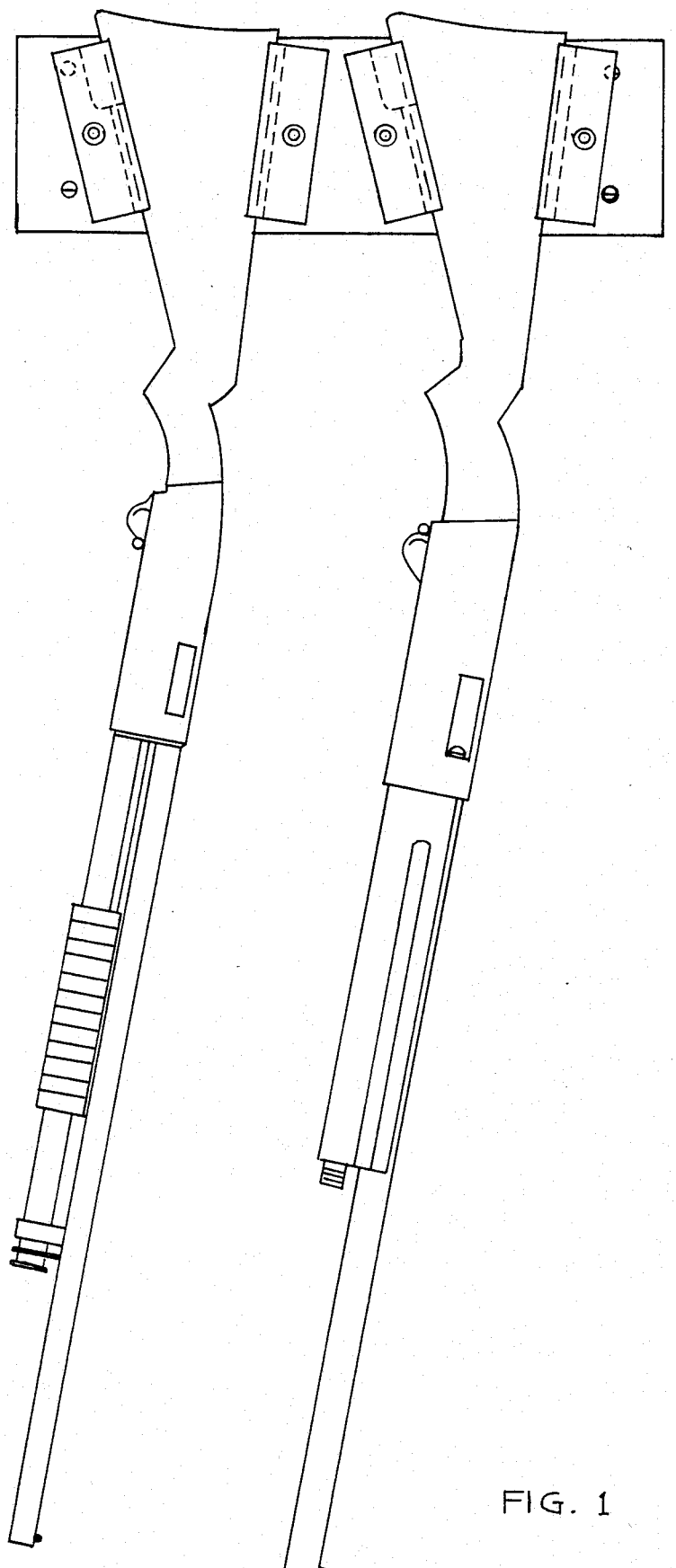
FIG. 1 shows a front elevation of the gun rack with guns in the stored position.

FIG. 1 shows the gun rack as it would appear in the mounted position with guns in place.

Figure 2:
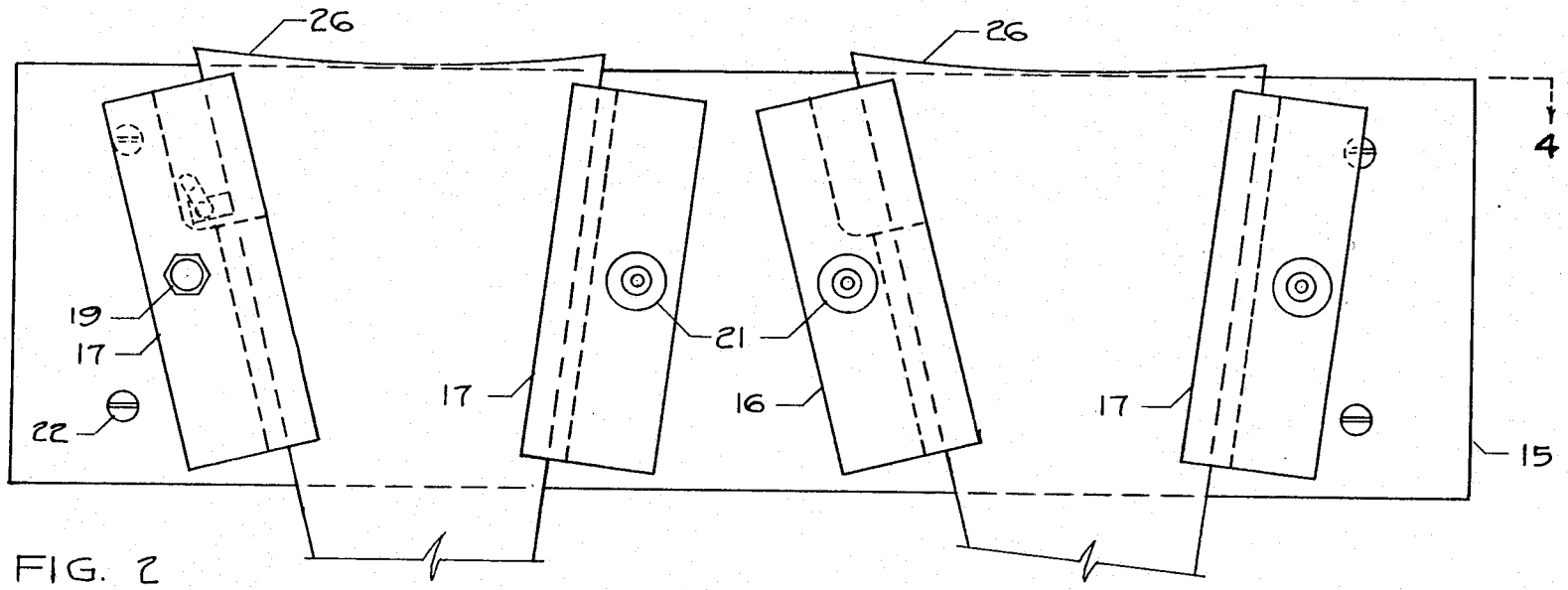
FIG. 2 shows a larger scale front elevation of the rack itself with several of the pieces identified by numbers.
Figure 4:
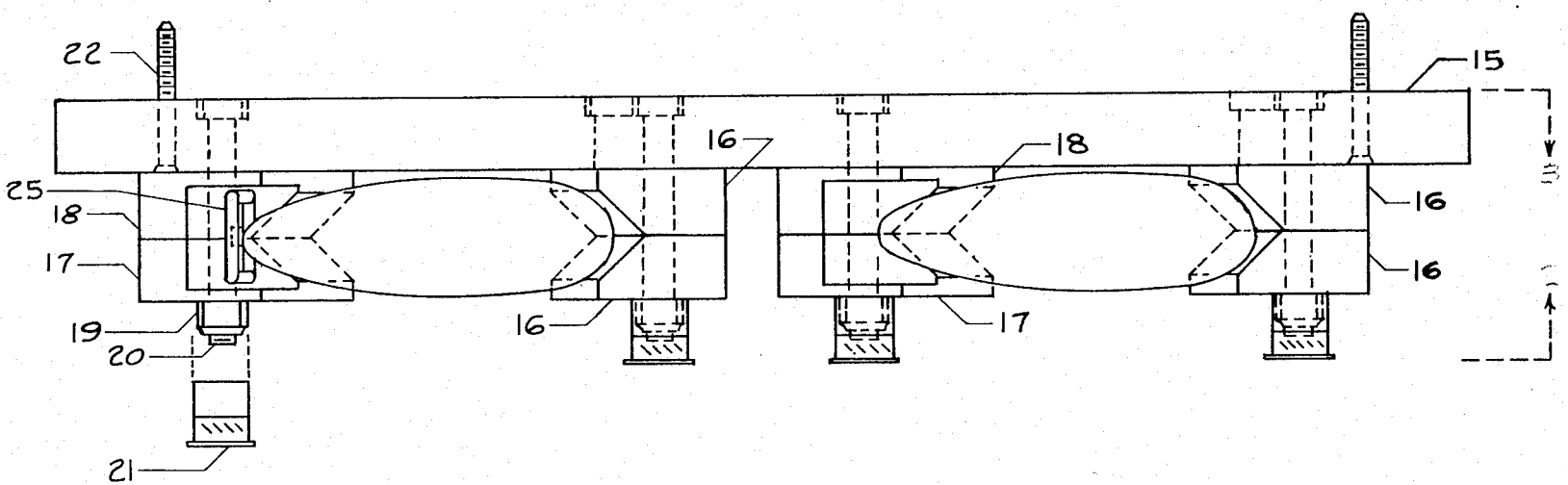
FIG. 4 shows a top view of the gun rack with guns in the stored position.
Figure 6:
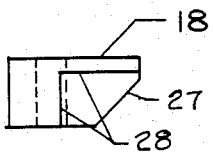
FIGS. 5,6,7 show the front elevation, top plan view, and right side elevation of dovetail wedge piece 18.
Figure 9:
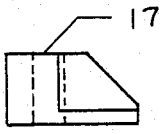
FIGS. 8,9,10 show the front elevation, top plan view, and right side elevation of dovetail wedge piece 17.
Figure 5:
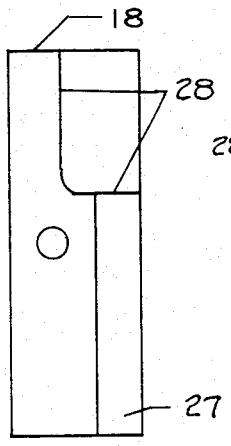
Figure 7:
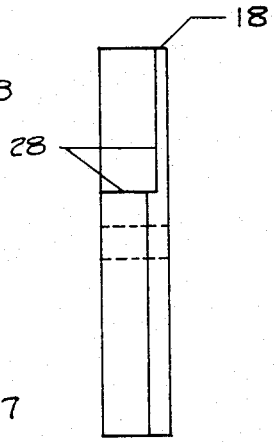
Figure 8:
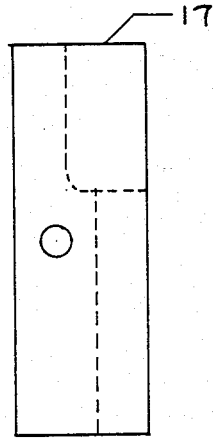
Figure 10:
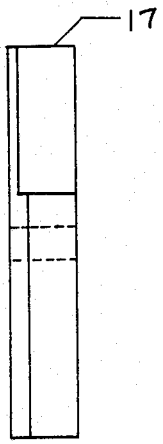
Figure 12:
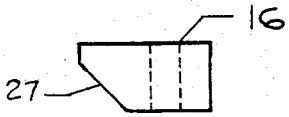
FIGS. 11,12,13 show the front and side elevation and top plan view of dovetail wedge piece 16.
Figure 11:
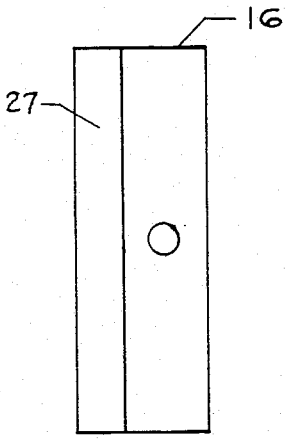
Figure 13:
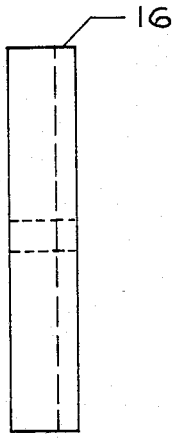

FIG. 2 and FIG. 4 show a larger scale drawing of the base plate 15, made from hard wood, as it would appear in the mounted position as viewed from the front in FIG. 2 and as viewed from the top in FIG. 4.

Referring to FIG. 2 and FIG. 4, the gun rack incorporates two sets of conforming dovetail wedges, made up of pieces 16, 17, and 18, made from soft wood, each set supporting the butt end of a gun stock 26. Each dovetail wedge set is comprised of a left hand assembly and a right hand assembley.

The left hand assembly consists of one wedge piece 17, and one wedge piece 18, mating faces held together by wedge support bolt 20 (attached to base plate 15), which acts as a pin around which the wedge pieces (now forming the left hand side of the dovetail wedge) can pivot, or rotate, allowing maximum contact length along the gun stock 26 which distributes the pressure thus preventing any undue stress on the stock.

The right hand assembly consists of wedge suport bolt 20 and two wedge pieces 16, one being rotated 180 degrees about a horizontal axis, then joined face to face with the other wedge piece 16, mating faces held together by support bolt 20, thus forming the right hand side of the dovetail wedge.

Both left hand and right hand wedge support bolts are secured to base plate 15 by locknut 19; locknut and support bolt end are covered by spent shell casing 21, cut to length. The lock nut is not normally tightened enough to prevent the wedge pieces from rotating to assume the gun stock shape, but is tightened enough to prevent them from swinging too freely and interefering with gun entry and exit. They may, however, be tightened enough to prevent rotating once the shape of a particular gun has been formed.

Construction of the Dovetail Wedge pieces no. 16,17,18 is detailed in FIG. 5 through FIG. 13. All pieces are constructed of soft wood (alternately formed metal or molded plastic may be used) and have one angled surface 27 (felt covered) and are drilled to receive the wedge support bolt 20. Pieces no. 17,18 have a notch 28 cut into the top end to receive a gun mounted sling swivel 25. Piece no. 18 (FIGS. 5,6,7) is similar to piece no. 17 (FIGS. 8,9,10) except that it is opposite hand. Piece no. 16 (FIGS. 11,12) is similar to pieces no. 17,18 except that the notch for a gun sling swivel is not required.

Figure 3:
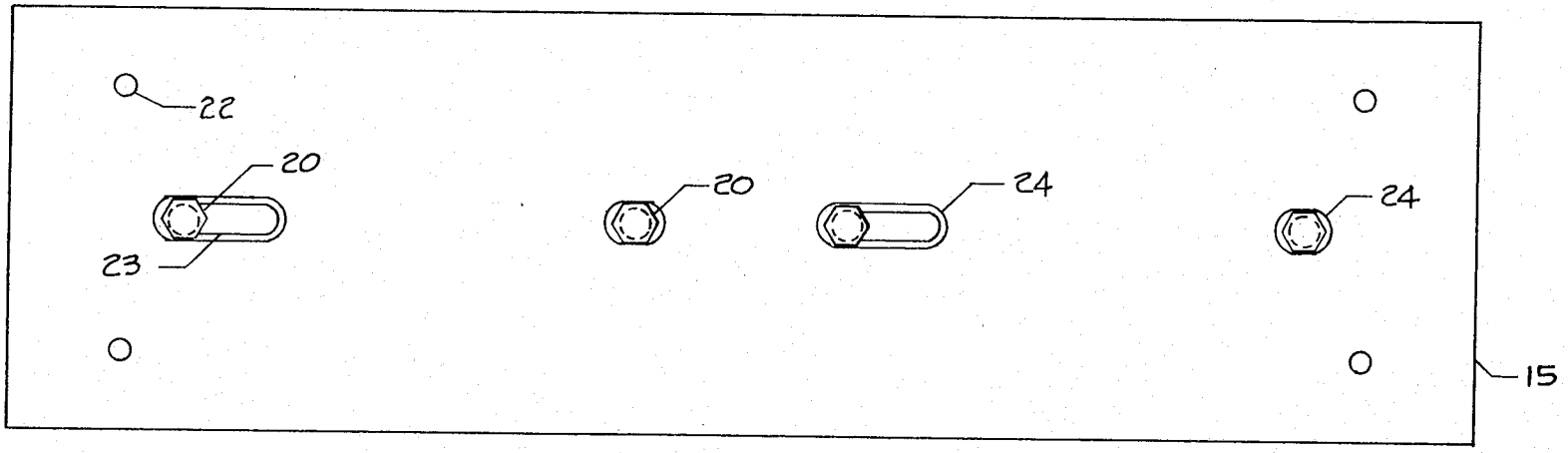
FIG. 3 shows a back elevation of the base plate, 15.

The base plate 15, shown in FIGS. 2,3,4 is constructed of hard wood. Referring to FIG. 3, Four holes are drilled for mounting screws 22. The holes on wall mounted models are spaced for alignment with typical wall stud spacing. The base plate is also drilled to receive the wedge support bolts 20. Two of these holes are slotted 23 for any adjustment required for gun stock width. Shallow slots 24 are cut in the back of the plate for recessing the bolt head and for preventing the bolt from turning during tightening of the lock nut.

A gun is removed from the rack by lifting it upward until the narrower portion of the stock clears the wedge, and then by moving it outward.

While the foregoing has described certain specific embodiments of the present invention, it is to be understood that these embodiments are being presented by way of example only. It is expected that others skilled in the art will perceive variations which, while differing from the foregoing, do not depart from the spirit and scope of the invention herein described and claimed.

I claim:

1. A gun rack for hanging guns comprised of a rectangular base plate on which are mounted wedge shaped pieces by means of bolts having lock nuts, said rectangular base plate of determined thickness drilled to receive screws for mounting said plate, additionally drilled to receive first and second wedge mounting bolts, drilled round hole to receive said first bolt, slotted on back to form recess for said first bolt head, said recess to prevent bolt from turning and to be at a depth and width equal to the height and width of the bolt head, elongated hole and elongated recess for said second wedge mounting bolt for width adjustment between said bolts, said bolts threaded ends extending outward 90 degrees from said plate for supporting wedge pieces, said first bolt supporting first and second wedge piece, said second bolt supporting third and fourth wedge pieces, said first and second wedge pieces being rectangular in shape of determined thickness having notch cut at top face side to receive rifle sling swivel, having a felt covered angled surface at one corner cut from said notch to bottom end and drilled for mounting on said first bolt, said pieces joining face to face, their respective angled surfaces forming first one-half of a gunstock shape conforming dovetail wedge, third wedge piece and fourth wedge pieces being rectangular in shape of determined thickness having a felt covered angled surface at one corner cut from bottom end to top end and drilled for mounting on said second bolt, said fourth wedge piece being rotated 180 degrees about its horizontal axis and joined face to face with said third wedge piece their respective angled surfaces forming second one-half of the said dovetail wedge, said bolt ends and said nuts being capped with previously fired shell casings cut to required length, a plurality of said dovetail wedges being made in manner described, said base plate being of determined length to accomodate plurality of said dovetail wedges.

* * * * *